United States Patent [19]

Sawrenko

[11] 4,128,970

[45] Dec. 12, 1978

[54] HONE

[76] Inventor: Peter Sawrenko, 5837 Patrick St., Burnaby, B.C., Canada, V5J 3B5

[21] Appl. No.: 772,382

[22] Filed: Feb. 28, 1977

[51] Int. Cl.[2] ..... B24B 23/00; B24B 3/36

[52] U.S. Cl. ..... 51/170 TL; 51/59 R; 51/181 R

[58] Field of Search ..... 51/170 TL, 181 R, 59 R; 30/272 A, 122; 15/22 A

[56] References Cited

U.S. PATENT DOCUMENTS

| | | | |
|---|---|---|---|
| 2,197,626 | 4/1940 | Von Scheven | 51/170 TL |
| 3,316,636 | 5/1967 | Raper et al. | 30/272 A |
| 3,736,614 | 6/1973 | Crostic et al. | 30/272 A |

FOREIGN PATENT DOCUMENTS

| | | | |
|---|---|---|---|
| 921642 | 1/1947 | France | 51/170 TL |

*Primary Examiner*—Harold D. Whitehead
*Assistant Examiner*—Roscoe V. Parker
*Attorney, Agent, or Firm*—Townsend and Townsend

[57] ABSTRACT

A hone adapted to be used with a domestic electric knife. The knife comprises an electric motor in a motor compartment and a reciprocable drive from the motor to a take off point adjacent one end of the motor compartment. There are attachments on the drive to enable reciprocable drive of blades from the take off point. The hone comprises two carrying arms each having at a first end engagement means to engage the attachment in the motor compartment at the take off point. A hone member is attached to each carrying arm adjacent a longitudinal edge of that arm-the arms are held together as they reciprocate when driven by the electric motor.

3 Claims, 3 Drawing Figures

HONE

FIELD OF INVENTION

This invention relates to a hone adapted to be used with a domestic electric knife.

DESCRIPTION OF PRIOR ART

In sharpening or honing a blade it is desirable that the hones or stones move as rapidly as possible across the edges to be sharpened. However, as a knife sharpener is used relatively infrequently in the normal home it is undesirable to provide a motor drive for a knife sharpener on the grounds of expense.

SUMMARY OF INVENTION

The present invention seeks to avoid the above problem by providing a hone that is adapted to be used with a domestic electric knife. Such a knife typically comprises an electric motor in a motor compartment and there is reciprocable drive from the motor to a take off point, adjacent one end of the motor compartment. The motor compartment may be used as a handle or, frequently, is formed with an integral handle. Typically such a compartment is modelled from a synethic resin. There are attachments on the reciprocable drive for the blades of the knife. In a typical domestic knife there are two removable blades that reciprocate rapidly relative to one another.

In the present invention the blades are replaced by the hone according to the present invention. That hone comprises two carrying arms each having at a first end engagement means to engage the attachment in the motor compartment at the take off point; a hone member attached to each carrying arm adjacent a longitudinal edge of that arm; and means to hold the arms together as they reciprocate when driven by the electric motor.

In a preferred embodiment each arm is formed with a flange adjacent one longitudinal edge to form a substantially L-shaped section. The hone member is attached, for example by adhesive, to the outer side of the flange.

Two hone members have been found adequate, especially if those hone members are each medium fine. However, in one embodiment of the invention there may be four hone members, one attached adjacent each longitudinal edge of each arm.

The means to hold the arms together may be any conventional method known in the electric knife art. Typically the means comprises a slot formed in a first arm adjacent the second end of said arm, that is the end remote from the take off point in the motor compartment. A corresponding projection is formed on the second end of the second arm to engage in the slot of the first arm. Typically the slot has a widened portion adjacent the slots inner end, that is the end nearer the motor compartment. The projection is formed with a head that is able to fit through the wider part of the slot but not the slot itself. This arrangement permits disconnection of the arms when they are not engaged with the attachment at the take off point of the motor compartment. The blades may be cleaned and stored separate.

BRIEF DESCRIPTION OF DRAWINGS

The invention is illustrated, merely by way of example, in the accompanying drawings in which.

DESCRIPTION OF PREFERRED EMBODIMENTS

Figure 1:
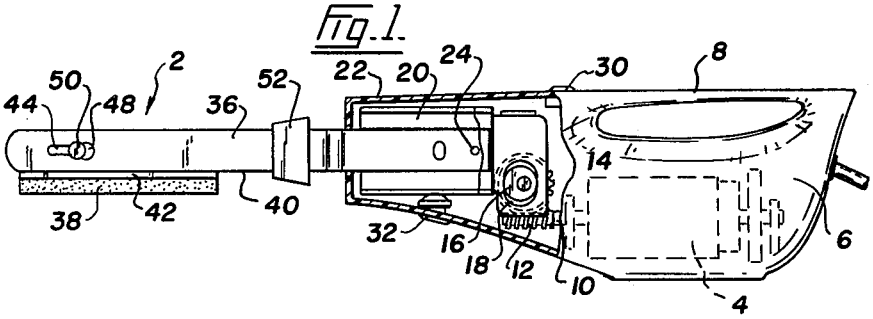
FIG. 1 is a view, partially in section, of a hone according to the present invention attached to a domestic electric knife.
Figure 2:
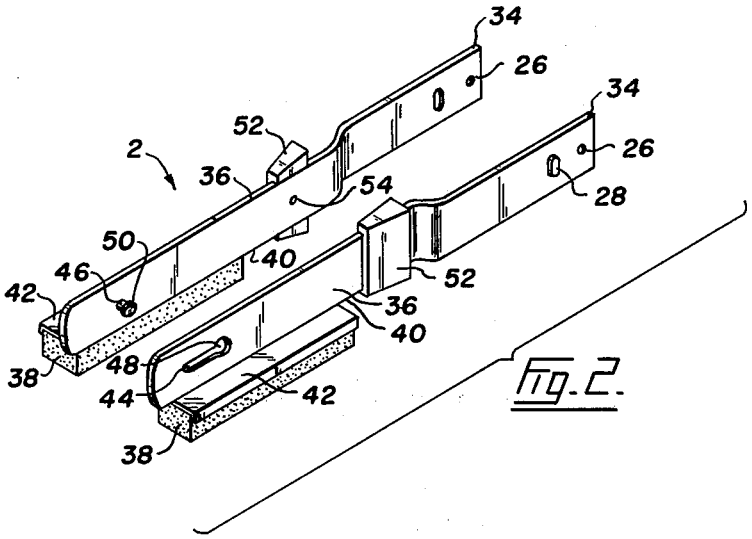
FIG. 2 is a perspective view of a hone according to the present invention.

FIG. 1 illustrates a hone generally indicated at 2 adapted to be used with a domestic electric knife. Such a knife typically has detachable blades. In the illustrated embodiment the electric knife is shown fairly diagrammatically since an essential feature of the present invention is that the electric knife is conventional. That is the hone according to the present invention may be adapted to be used with any electric knife. The illustrated domestic knife comprises an electric motor 4 positioned in a motor compartment 6 that is molded from a plastic material and includes an integrally molded handle 8. There is a reciprocable drive from the motor 4 that comprises a drive shaft 10 having attached to it a worm 12. Worm 12 engages a gear 14 and gear 14 is formed, around its centre, with two cams 16, one on each side. Cams 16 engage oval openings 18 in housings 20 for the blades of the knife. Oval openings 18 are elongated in a direction perpendicular to the direction of reciprocation of the blades of the knife. Housings 20 are formed with means to permit attachment of the blades of the knife at a take off point adjacent one end 22 of the motor compartment 6. In the illustrated embodiment the housings 20 are formed with small pegs 24 to engage a hole 26 adjacent an end of the blades. The hole 26 is shown in the hone of FIG. 2. There is an outwardly extending projection 28 which engages in a corresponding depression (not shown) in a housing 20. The housings 20 are symmetrical about a central, longitudinal axis for the motor compartment 6.

The housing compartment is provided with an on-off switch 30 and with a button 32 that, upon pressing, forces apart the two housings 20 to permit removal of the blades.

Referring to FIG. 2, the hones according to the present invention are, at first ends 34 precise replicas of the knife blades that would normally be used with the domestic electric knife. Holes 26 engage pegs 24 in the housings 20 of the knife. The projections 28 engage corresponding depressions (not shown) in housings 20 so that the hone according to the present invention may be driven in exactly the same manner and exactly at the same speed as the knives of the domestic electric knife. The drive is reciprocable. This is brought about by the cams 16 rotating in the oval openings 18. As the cams 16 rotate it will be seen that they force a housing 20-and thus a blade-forward and backward as the cam rotates. The oval shape of the openings 18 prevent upward movement of the blades, that is the cam portions cannot contact the upper and lower sides of the openings 18 in the housings 20.

Hone 2 comprises carrying arms 36 each having at their first ends 34 engagement means to engage the attachment in the motor compartment of the take off point 22 as described above. There is a hone member 38 attached to each carrying arm 36 adjacent a longitudinal edge 40 of the carrying arm 36. In the illustrated embodiment the location of the hone members 38 is facilitated by the provision of flanges 42 to which the hone members 38 are attached, for example, by adhesive.

The hone has means to hold the arms 36 together as they reciprocate when driven by the electric motor. This means comprises an elongated slot 44 formed in one of the arms. There is a corresponding projection 46 formed on the other arm. Slot 44 is widened at 48 and projection 46 is formed with a head 50. Head 50 can slide through the widened part 48 of the slot 44 and projection 46 then engages in the slot 44. Once the blades are placed together and attached in the motor compartment the amount of reciprocation provided by the drive from the electric motor 4 is not sufficient to enable the head 50 to align with the widened portion 48. That can only be done by disconnecting the carrying arms 36 from the motor compartment 6 and removing the carrying arms 36 from the compartment 6. The carrying arms 36 may then be separated from each other.

The carrying arms 36 are provided with plastic or the like members 52 attached by rivets 54. Members 52 are simply to facilitate storage of the carrying members 36 and play no significant part in the invention. They are conventional in prior domestic electric knife blades.

The device illustrated in FIGS. 1 and 2 operates as follows. First the carrying arms 36 are pressed into the take off openings at the one end 22 of the motor compartment 6. The device is then ready for use. Switch 30 is pressed and the hones 2 reciprocate rapidly. Each carrying arm 36 reciprocates in a direction opposed to the other arm 36. The reciprocating hones 38 may be run across the edge of a blade making a large number of passes across the blade during one sweep of the hand along the length of the blade. Thus the device illustrated is used in the same manner as a conventional hone or steel in sharpening knives.

Figure 3:
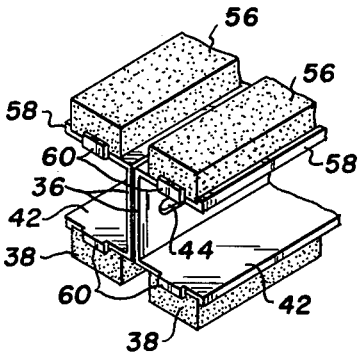
FIG. 3 illustrates a second embodiment of a hone according to the invention.

The embodiment illustrated in FIG. 3 merely differs by the provision of additional hone members 56 attached to flanges 58 on the second longitudinal edge of the carrying arms 36. In addition the flanges 42 and 58 are shown with end flanges 60 to facilitate location of the hone members 38 and 56 on the flanges 42 and 58 respectively.

Generally speaking it is satisfactory simply to have two members 38, as shown in FIGS. 1 and 2. Four hone members 38 and 56 are not normally considered necessary. The "extra" hones 56 permit a device in which one side can be used for sharpening the other for polishing. Thus the hone members 38 may be fine and the hone members 56 coarse.

The hone members used should be suitable for high speed grinding and should not clog easily. It is also desirable to make them replaceable on the mounting flanges. A useful embodiment has been to use only two medium fine hone members 38.

It is emphasized that the hone members 38 and 56 are conventional material, carborundum and the like, normally used for hones. They can be carborundum files.

The hone members 38 and 56 may be shaped to permit their use with serrated blades.

I claim:

1. In an household appliance adapted to slice foodstuffs including an electric motor, a motor compartment housing the motor and having means for holding the compartment, first and second drive attachments disposed within the compartment adjacent and end thereof and accessible from the exterior of the compartment, the drive attachments being mounted for relative reciprocal, linear movement and being further formed to receive a pair of reciprocating knife blades, and drive means operatively coupling the motor and the drive attachments for linearly reciprocating the attachments upon the energization of the motor, the improvement of means for converting the appliance into a blade honing and sharpening tool comprising:

first and second, linear carrying arms, each arm having a first end formed for engaging one of the drive attachments so that the attachments can linearly reciprocate the arms;

first and second hone members directly attached to the first and second arms, respectively, for linear reciprocating movement therewith, each member having an elongate configuration and extending in the direction of the respective carrying arms; and means formed on the carrying arms for interengaging the arms and permitting them to linearly reciprocate with respect each other, while preventing substantial relative motion between the arms in other directions;

whereby the energization of the motor induces relative linear reciprocating motion between the carrying arms and therewith between the hone members so that an edge of a blade to be honed can be drawn into contact with the linearly reciprocating hone members and the reciprocating members thereby hone and sharpen the edge of the blade.

2. A hone as claimed in claim 1 in which each arm is formed with a flange adjacent one longitudinal edge to form a substantially L-shaped section, the hone member being attached to the outer side of the flange.

3. A hone as claimed in claim 1 including four hone members, one attached adjacent each longitudinal edge of each arm to form a hone having four hone members.

* * * * *